United States Patent [19]

Kim

[11] Patent Number: 4,767,069

[45] Date of Patent: Aug. 30, 1988

[54] MULTIPURPOSE PULVERIZER DEVICE

[76] Inventor: Chong S. Kim, #155-7 Shimkok 2-Dong, Bucheon City, Kyeonggi D., Rep. of Korea

[21] Appl. No.: 36,507

[22] Filed: Apr. 9, 1987

[51] Int. Cl.[4] ..... B02C 18/12

[52] U.S. Cl. ..... 241/152 A; 241/160; 241/162; 241/224; 241/239; 241/257 R

[58] Field of Search ..... 241/152 A, 224, 237, 241/239, 241, 242, 257 G, 160, 162, 222, DIG. 38, 169.1, 46 B, 46.06, 46.04, 257 R

[56] References Cited

U.S. PATENT DOCUMENTS

| | | | |
|---|---|---|---|
| 4,171,103 | 10/1979 | Rossler | 241/152 A |
| 4,275,848 | 6/1981 | Webb | 241/169.1 X |
| 4,440,352 | 4/1984 | Rossler | 241/152 A |

*Primary Examiner*—Mark Rosenbaum
*Attorney, Agent, or Firm*—Barnes & Thornburg

[57] ABSTRACT

A pulverizer device is provided for pulverizing food, garbage and the like. The pulverizer includes a housing with a centrally disposed, rotatable shaft carrying a plurality of cutting and grinding stages which cooperate with opposingly mounted cutting and grinding counterparts to sequentially pulverize the material. In order to accommodate a simple to manufacture and easily adjustable modification of the pulverizer device so as to be usable with both garbage and the grinding of certain food stuffs such as grain and spices, there is provided a manually adjustable annular ring mounted at the lowest stage of the pulverizer. A handle protrudes outwardly through a housing wall slot to accommodate rotation of the ring to effectively raise and lower the same to engage and disengage the last pulverizing stage. A closure flap with a weighted end is pivotally mounted at the inlet to the pulverizer housing to maintain the inlet in a closed position in the absence of incoming material to be pulverized, to thereby prevent escape of noxious fumes.

18 Claims, 2 Drawing Sheets

MULTIPURPOSE PULVERIZER DEVICE

BACKGROUND AND SUMMARY OF THE INVENTION

The present invention relates to a multipurpose pulverizer device, such as a garbage disposal, or food grinder, used for pulverizing food, garbage and the like. The device of the present invention is designed to adequately pulverize such material at restaurants or at individual homes.

Known pulverizers are practically restricted for use to pulverize either garbage such as in a garbage disposal, or food stuffs, such as grains and spices. Any such pulverizers that possibly could accommodate both uses, namely pulverizing of garbage and pulverizing of certain types of food stuffs such as grains and spices, are very complicated, and also very expensive to manufacture and utilize. The different requirements of a garbage disposal and a grain or spice grinder or pulverizer are such that different levels of cutting and grinding are required for the different material being processed due to the end product desired.

Another problem with many prior art pulverizing devices related to the leaking of offensive, odorous fumes from the inside of the device back through the inlet opening.

An object of the present invention is to improve upon the above-noted prior pulverizing devices to provide an economical, simple to manufacture, pulverizing device that can be selectively utilized for pulverizing garbage and for grinding food stuffs such as grains and spices. This object is achieved according to the invention by providing a multistage pulverizer with a central motor-driven shaft disposed inside of the pulverizer housing, with a manually adjustable mechanism for effectively adjusting, engaging and disengaging a final stage of pulverizing, dependent upon the desired level of pulverizing desired. In especially preferred embodiments of the invention, the adjustability of the last stage of pulverizing is provided by mounting a last stage cutting ring at the inside of the housing so as to be movable along a spiral track, with a manually engageable handle protruding out of the housing wall, whereby the vertical height of the cutting ring can be very simply manually adjusted between positions with a very fine cutting and grinding at the last stage, to a position wherein the material is practically not further pulverized at this last stage.

Another object of the present invention is to provide a pulverizer device which avoids by simple means the escape of smelly gases from inside the pulverizer back through the inlet opening. This object is achieved by providing a closure flap at the inlet of the pulverizer device, which closure flap is normally biased in a closing position and which is responsive to the supply of material to be pulverized to move away to permit entry of such material. In especially preferred embodiments, the closure flap includes a pivotally mounted flap at the housing, which has a weighted end at the outside of the housing for biasing the flap toward the closed position.

Other objects, advantages and novel features of the present invention will become apparent from the following detailed description of the invention when considered in conjunction with the accompanying drawings.

DETAILED DESCRIPTION OF THE DRAWINGS

Figure 1:
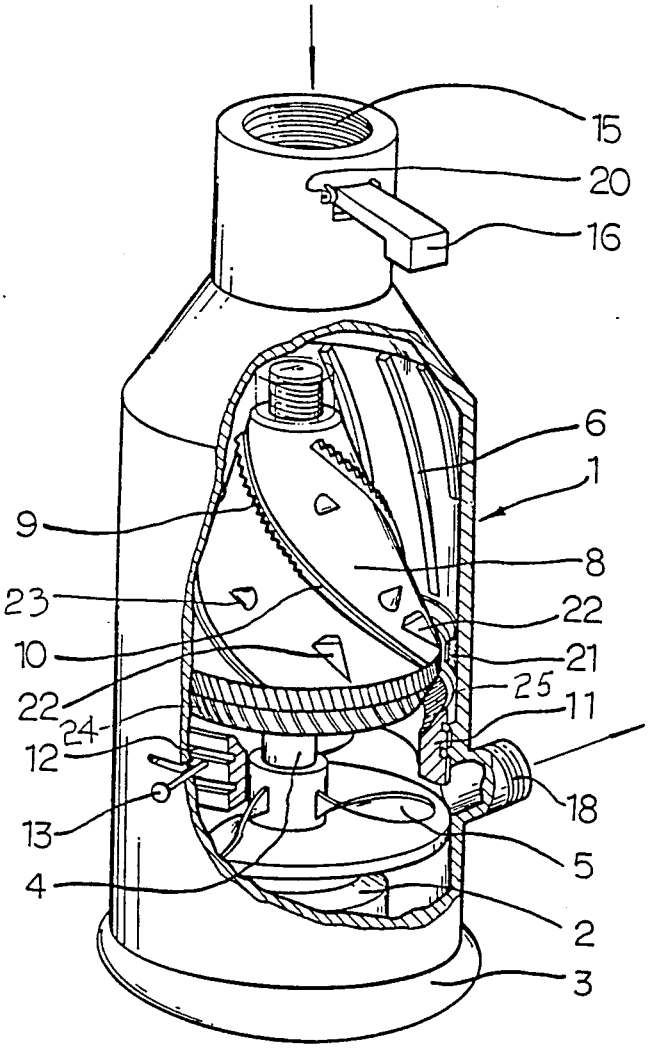
FIG. 1 is a perspective lateral, partly cut away view of a pulverizer device constructed in accordance with a preferred embodiment of the present invention.
Figure 2:
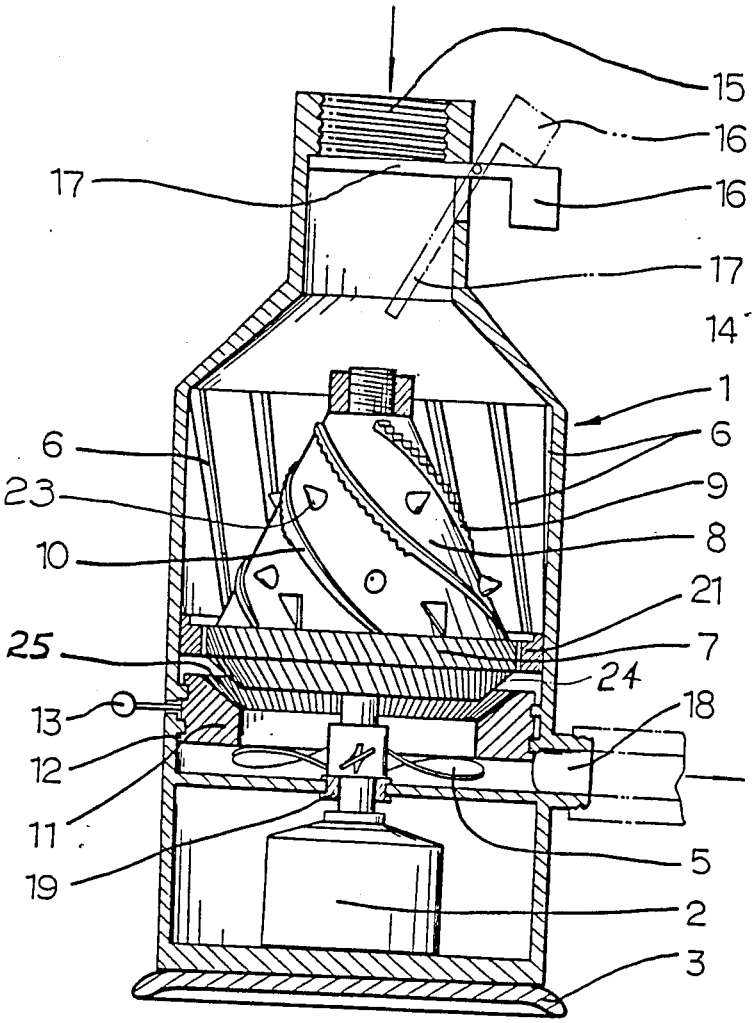
FIG. 2 is a sectional lateral view of the pulverizer device of FIG. 1.

Referring now to the drawings wherein like reference numerals are used in the two views to designate similar structures, there is provided a pulverizer device with a housing 1. At the lower part of the housing 1 there is disposed a motor 2 and an upwardly extended motor-driven rotor shaft 4. The housing 1 is mounted on a base 3 which can accommodate mounting of the pulverizer device and/or placement of same on a shelf or the like. An inlet opening 15 is provided at the top of the housing 1 and a discharge opening 18 is provided at a lateral side of the lower portion of the housing, leading from a housing chamber directly above the housing chamber that contains the motor 2.

At the inlet opening 15, there is provided a movable pivotally mounted closure flap 17 which has a weight 16 at the outer end thereof for biasing the flap 17 toward the closed position. This closure flap 17 serves to prevent the escape of smelly gases when the pulverizer device is not being used or when materials to be pulverized are not being supplied through the opening 15. The flap 17 and weight 16 are designed so as to accommodate automatic opening of flap 17 in response to the supply of garbage or food stuffs through the opening 15 against the top surface of flap 17.

Immediately below the inlet 15 and closure flap 17, there is an outwardly tapering section of the housing 1, which leads to a cylinderical section having a first set of cutting teeth 6 extending in a slight spiral along the inside of the walls of the housing 1. A conically-shaped drum part 8 is mounted on the rotor shaft 4 for movement therewith and carries on its outer surface a plurality of spirally-shaped ribs or blades 10, with teeth 9 formed by protrusions and indentations. In between the spiral blades 10, there are provided additional devices for aiding in the pulverizing process, including miniature blades 22 and conical protrusions 23. The drum 8, with its blades 10 and protrusions 22, 23, is rapidly rotated by the motor 2 and cooperates with the fixed blades 6 to form a first pulverizing stage for the garbage or food stuffs to be pulverized.

Immediately below the drum 8, there is provided, either integrally formed with the drum 8 or on a separate part fixed thereto, a ring-shaped set of teeth 7 which cooperate with a fixed set of teeth 21 to form a second pulverizing state for the material to be processed. The material being processed, after going through the first stage and being roughly cut and pulverized, is fed between the fixed blades 21 and the rotating blades 7 which form a second pulverizing stage.

A third pulverizing stage is disposed below the blades 7, 21. This third stage includes a conically, inwardly, downwardly tapering set of blades 24 which are fixedly connected to shaft 4 for rotatable motion with the shaft 4. Cooperating with these blades 24 is a further set of blades 25 mounted on an annular ring 11. Ring 11 is in turn mounted by spiral tongue and groove connections 12 at the inner wall of housing 1. A manually operable handle 13 is connected to the annular ring 11 and accommodates manual adjustment of the vertical position of ring 11. Vertical adjustment of ring 11 effectively changes the gap between the set of blades 24 and set of blades 25 so that the device can be operated with a third pulverizing stage with very fine grinding or cutting of the material being processed to a position permitting movement of the material being processed past the third stage in the downward direction without a third stage of pulverizing.

Underneath the adjustable annular ring 11, there is mounted a set of discharge paddles 5 on the rotor 4, for assisting and forcing the pulverized material out of the outlet opening 18.

Depending upon the nature of the garbage or foodstuffs to be processed by the pulverizing device, the third stage pulverizing blades 24, 25 can be manually adjusted to the appropriate position so as to effectively engage or disengage this third stage pulverization. In this manner, this same pulverizing device can be very simply manufactured and very simply adjusted between different respective operating phases for different materials to be pulverized. Since the vertically adjustable ring 11, with blades 25, is mounted in annular tongue and groove connections at the housing wall, the construction is quite simple, and the sealing of the space leading to the handle 13 from outwardly through a slot in the housing wall is simply and reliably accomplished.

In order to protect the motor 2 and the lower portion of the housing accommodating the motor, there is a sealing bearing connection 19 at the bottom of the housing portion accommodating the flow of materials to be pulverized.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. Multipurpose pulverizer device for pulverizing food, garbage and the like material, comprising:

housing means;

material inlet means at an upper part of the housing means for accommodating inflow of material to be pulverized;

material outlet means at a lower part of the housing means for accommodating outflow of material pulverized in the pulverizer devioe;

rotor shaft means disposed centrally of the housing means;

motor means for rotatably driving the rotor shaft means;

an upper movable pulverizing unit carried by the rotor shaft means for rotation therewith;

an upper fixed pulverizing unit disposed on the inside of the housing means and adjacent to the upper movable pulverizing unit for cooperating with the upper movable pulverizing unit to perform a first pulverizing operation on the material to be pulverized;

a set of movable second stage cutter teeth carried by the rotor shaft means and disposed below the upper pulverizing unit;

a set of fixed second stage cutter teeth disposed on the inside of the housing means and adjacent the movable second stage cutter teech for cooperating with the movable second stage cutter teeth to perform a second pulverizing operation on the material to be pulverized;

a set of movable third stage cutter teeth carried by the rotor shaft means and disposed below the second stage cutter teeth;

a set of fixed third stage cutter teeth disposed on the inside of the housing means and adjacent the movable third stage cutter teeth for cooperating with the movable third stage cutter teeth to perform a third pulverizing operation on the material to be pulverized;

discharge paddle means carried by the rotor shaft means and disposed below the third stage cutter teeth, said discharge paddle means serving to force the pulverized material out the material outlet means; and third stage adjustment means for accommodating manual adjustment of the space between the movable and fixed third stage cutter teeth to thereby effectively selectively apply said third pulverizing operation.

2. Device according to claim 1, further comprising a movable closure member disposed in the material inlet means, said closure member being biased toward a closing position and being openable by contact of incoming material to be pulverized, whereby said closure member limits outflow of noxious gaseous fumes when material is not being supplied to the material inlet means.

3. Device according to claim 1, wherein said upper movable pulverizing unit includes a downwardly radially outwardly tapering support drum with spirally disposed cutting teeth extending over the length thereof, said spirally-shaped teeth including protrusions and depressions at the radial outer edges thereof.

4. Device according to claim 3, wherein the upper pulverizing unit has an axial extent along the rotor shaft means which is substantially greater than the combined axial extend of the second and third stage cutter teeth.

5. Device according to claim 4, wherein said second stage fixed cutter teeth are permanently fixed to the inside of the housing means and exhibit a cylindrical outer profile.

6. Device according to claim 5, wherein said third stage fixed cutter teeth are carried by a cutter teeth mounting ring which is movably guided in respective interengaging groove means at the housing means.

7. Device according to claim 6, wherein said material inlet and outlet means are provided with respective threaded connection means.

8. Device according to claim 6 wherein said interengaging groove means extend in a spiral path around the inside of the housing means and the radial outer edge of the mounting ring.

9. Device according to claim 8, wherein said third stage fixed cutter teeth exhibit a conical upwardly expanding profile.

10. Device according to claim 9, comprising a manually engageable handle protruding radially outward from the mounting ring through or open slot in the housing means.

11. Device according to claim 3, further comprising conically-shaped protrusions on the support drum between respective spiral cutting teeth, said protrusions serving as miniature cutting teeth.

12. Device according to claim 11, wherein the upper pulverizing unit has an axial extent along the rotor shaft means which is substantially greater than the combined axial extent of the second and third stage cutter teeth.

13. Device according to claim 1, wherein the upper pulverizing unit has an axial extent along the rotor shaft means which is substantially greater than the combined axial extent of the second and third stage cutter teeth.

14. Device according to claim 13, wherein the axial extent of the second and third stage cutter teeth are approximately equal to one another.

15. Device according to claim 1, wherein said third stage fixed cutter teeth are carried by a cutter teeth mounting ring which is movably guided in respective interengaging groove means at the housing means.

16. Device according to claim 15, wherein said interengaging groove means extend in a spiral path around the inside of the housing means and the radial outer edge of the mounting ring.

17. Device according to claim 16, wherein said third stage fixed cutter teeth exhibit a conical upwardly expanding profile.

18. Device according to claim 17, comprising a manually engageable handle protruding radially outward from the mounting ring through or open slot in the housing means.

* * * * *